US006924602B2

(12) United States Patent
Komiya

(10) Patent No.: US 6,924,602 B2
(45) Date of Patent: Aug. 2, 2005

(54) ORGANIC EL PIXEL CIRCUIT

(75) Inventor: Naoaki Komiya, Kobe (JP)

(73) Assignee: Sanyo Electric Co., Ltd. (JP)

( * ) Notice: Subject to any disclaimer, the term of this patent is extended or adjusted under 35 U.S.C. 154(b) by 0 days.

(21) Appl. No.: 10/074,405

(22) Filed: Feb. 12, 2002

(65) Prior Publication Data

US 2002/0158587 A1 Oct. 31, 2002

(30) Foreign Application Priority Data

Feb. 15, 2001 (JP) ..... 2001-038642

(51) Int. Cl.[7] ..... G09G 3/32
(52) U.S. Cl. ..... 315/169.3; 345/76
(58) Field of Search ..... 315/169.1–169.4; 345/60, 65, 76–80, 84

(56) References Cited

U.S. PATENT DOCUMENTS 6,366,025 B1 * 4/2002 Yamada ..... 315/169.3
6,441,560 B1 * 8/2002 Hunter ..... 315/169.3
6,476,419 B1 * 11/2002 Yasuda ..... 345/76
6,486,606 B1 * 11/2002 Ting ..... 315/169.1
6,501,448 B1 * 12/2002 Komiya et al. ..... 345/80
6,542,138 B1 * 4/2003 Shannon et al. ..... 345/76

* cited by examiner

*Primary Examiner*—Wilson Lee
(74) *Attorney, Agent, or Firm*—Cantor Colburn LLP

(57) ABSTRACT

A discharge transistor (TFT3) which connects the upper end of an organic EL element (EL) and a negative power source (VEE) and a control transistor (TFT4) which connects the upper end of a storage capacitor (SC) with a power source (PVDD) are provided. These transistors (TFT3, TFT4) are turned on by the upper gate line, so that the capacitor of the organic EL element (EL) is discharged prior to the selection of the line for these transistors.

12 Claims, 8 Drawing Sheets

ORGANIC EL PIXEL CIRCUIT

BACKGROUND OF THE INVENTION

1. Field of the Invention

The present invention relates to an organic EL pixel circuit for controlling application of a drive voltage to an organic EL pixel.

2. Description of Related Art

Use of organic EL panels as flat panel displays has been conventionally known. Because the pixels in an organic EL panel are self-illuminating, an organic EL panel has advantages including that, unlike a liquid crystal display, no backlight is required and that the display is relatively bright.

FIG. 8 illustrates an example structure of a pixel circuit in an organic EL panel employing conventional thin film transistors (TFTs). An organic EL panel is composed of these pixels arranged in a matrix.

FIG. 8 shows the gate of a selection transistor TFT1, which is an n-channel thin film transistor to be selected by a gate line and which will hereinafter be referred to simply as TFT1, connected to a gate line extending in the row direction. The drain of the TFT1 is connected with a data line extending in the column direction. The source of the TFT1 is connected with one end of a storage capacitor SC having the other end connected a storage capacitor power source line. The node connecting the source of the TFT1 and the storage capacitor SC is connected with the gate of a drive transistor TFT2 which is a p-channel thin film transistor (which will be hereinafter referred to simply as TFT2). The source of the TFT2 is connected to a power source PVDD and the drains of the TFT2 is connected with one end of an organic EL element EL. The other end of the organic EL element EL is connected with a cathode power source CV.

In the circuit thus configured, when the gate line is at H level, the TFT1 is turned on, and the data in the data line at this point is stored in the storage capacitor SC. The TFT2 is switched on and off in accordance with the data (potential) held by the storage capacitor SC. When the TFT2 is on, an electrical current flows through the organic EL element EL, which then emits light.

Light emission of each pixel is controlled in the manner described above. Because of the existence of the storage capacitor SC, the organic EL element EL is capable of emitting light even after the TFT1 is turned off. The storage capacitor SC typically retains the ON or OFF state of the TFT2 until the next gate line is selected.

In an organic EL panel employing such above-described TFTS, the pixels arranged in a matrix and each including the organic EL element, TFT1 and TFT2, are disposed on the same substrate. This structure results in generation of a parasitic capacitor in the organic EL element EL.

Accordingly, such a conventional pixel circuit has a problem that even when the TFT2 is off, a current flows in the organic EL element EL in accordance with the charges accumulated in the capacitor of the organic EL element, thereby generating an afterimage. More specifically, while the panel operates at a high response speed when the organic EL element is turned on, the response becomes slower due to the influence of the capacitor of the organic EL element when the organic EL element is turned off, with a result that afterimages are common.

SUMMARY OF THE INVENTION

The present invention was conceived in view of the aforementioned problems of the prior art and aims to provide an organic EL pixel circuit capable of effectively preventing generation of an afterimage.

In accordance with the present invention, charges which are accumulated in the capacitor of the organic EL element can be discharged by a discharge transistor. Accordingly, it is possible to prevent an afterimage from being generated due to the charges which are accumulated in the capacitor of the organic EL element, thereby preventing the organic EL element from being retained ON when the organic EL element switches OFF.

Preferably, the organic EL pixels are arranged in a matrix, the pixels in a row direction are selected by the same gate line, and the discharge transistor is driven by the gate line selected at a timing prior to the selection of the gate line at the row of the EL element to which the discharge transistor is connected, to thereby discharge the charges accumulated in the capacitor of the organic EL element. Prevention of afterimage generation can thereby be ensured because the capacitor of the organic EL is thus discharged in advance.

It is also preferable that the discharge transistor is driven by a dedicated discharge line which is activated at a timing prior to the selection of the gate line at the row of the EL element to which said discharge transistor is connected, to discharge the charges accumulated in the capacitor of the organic EL element.

Further, it is preferable that each pixel includes a storage capacitor for holding a control voltage to be applied to a drive transistor which controls application of a drive current to the organic EL element, and further includes a control transistor for controlling the control voltage held in the storage capacitor to turn the drive transistor off. It is thus possible to turn the drive transistor off by performing discharge using the control transistor.

It is also preferable that the control transistor is driven simultaneously with said discharge transistor to turn the drive transistor off at the time of driving said discharge transistor, i.e. when the discharge transistor is turned on. This leads to advantages that the display period is maintained, the wiring is shortened, and prevention of afterimage generation is ensured. Further, a simultaneous ON state of the drive transistor and the discharge transistor can also be prevented.

It is also preferable that the control transistor is driven prior to the discharge transistor to thereby turn the drive transistor off prior to driving the discharge transistor. This can further ensure prevention of a simultaneous ON state of the drive transistor and the discharge transistor.

It is also preferable that the organic EL pixels are arranged in a matrix, that each of the pixels emits light of a color which is predetermined for each pixel, and that a discharge transistor and/or a control transistor for a pixel which emits light of a color with low emission efficiency is disposed within a pixel which emits light of a color with high emission efficiency. For example, when each pixel in an organic EL element emits light of R (red), G (green), or B (blue), the emission efficiency for R is low and the emission efficiency for G is high, with the emission efficiency for B being in the middle. Therefore, by disposing the discharge transistor and/or the control transistor for R pixel within G pixel, the aperture ratio of the R pixel can be increased. Thus, the aperture ratio of a pixel with a low emission efficiency (for example, R pixel) can be increased to thereby suppress an increase in the drive voltage, so that the entire power consumption can be reduced.

BRIEF DESCRIPTION OF THE DRAWINGS

These and other objects of the invention will be explained in the description below, in connection with the accompanying drawings, in which.

DETAILED DESCRIPTION OF THE PREFERRED EMBODIMENTS

Preferred embodiments of the present invention will be described in further detail with reference to the accompanying drawings.

Figure 1:
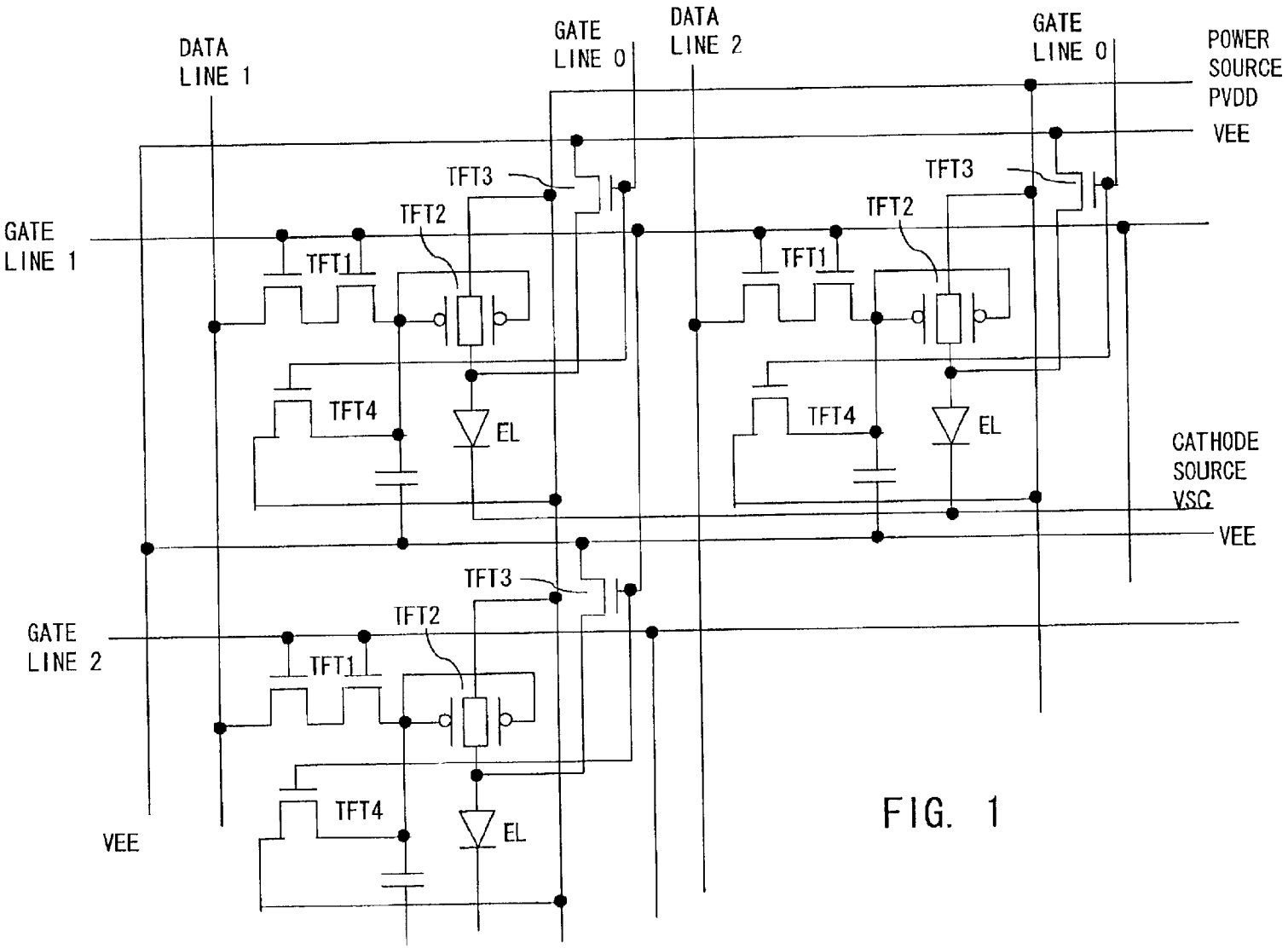
FIG. 1 is a diagram showing a structure of a pixel circuit according to one embodiment of the present invention.

FIG. 1 illustrates a structure of a pixel circuit corresponding to one pixel portion according to one embodiment of the present invention. To a gate line extending in the horizontal direction, a TFT1 comprising a n-channel TFT is connected. The TFT1, which is formed as a double-gate type TFT having TFTs connected in series in this embodiment, need not necessarily be of the double-gate type.

The other end of the TFT1 is connected with one end of the storage capacitor SC. The other end of the storage capacitor SC is connected with VEE, which is a negative power source of the panel. To the node connecting the TFT1 and the storage capacitor SC, the gate of the drive transistor TFT2 comprising a p-channel TFT is connected. The TFT2, which is formed of two TFTs connected in parallel, has one end connected with the panel power source PVDD and the other end connected with one end of the organic EL element EL. The other end of the organic EL element is connected with a cathode provided at an opposing substrate.

To the node connecting the TFT2 and the organic EL element, one end of a discharge transistor TFT3 having the other end connected with the VEE is connected. The gate of the discharge TFT3 is connected to the upper gate line. Specifically, with regard to the TFT3 of the upper left pixel in FIG. 1, the gate of the TFT3 is connected to the gate line 0 which is one horizontal line above the gate line 1 to which the TFT1 of the pixel for the TFT3 is connected.

Further, to the node connecting the TFT1 and the storage capacitor SC, one end of a control transistor TFT4 is connected. The other end of the control transistor TFT4 is connected with the power source PVDD. The gate of the control transistor TFT4 is connected with the upper gate line, similarly to the gate of the TFT3 described above.

In the organic EL pixel circuit thus configured, the gate lines are sequentially turned on by the vertical driver. Specifically, in displaying one screen defined by a vertical synchronization signal, the gate lines corresponding to the horizontal lines for performing display are sequentially turned on in accordance with the horizontal synchronization signal.

Further, during one horizontal period in which one gate line is on, the data lines are sequentially connected with the video signal line by the horizontal driver, so that data corresponding to each pixel is supplied via the TFT1 to the gate of the TFT2 and the storage capacitor SC. Accordingly, data is basically supplied in a dot sequential manner. The data thus supplied is stored in the storage capacitor, and the ON or OFF state of the TFT2 is maintained thereafter. When the TFT2 is on, an electrical current flows from the power source PVDD into the organic EL element EL, which then emits light.

In this embodiment, the TFT2, which is a p-channel TFT, turns off when the charges are held in the storage capacitor Sc and the gate of the TFT2 is at H level. The TFT2 turns on when the charges are discharged and the gate of the TFT2 becomes L level.

According to this embodiment, the TFT3 is turned on by the upper gate line. Specifically, the upper side of the organic EL element EL, namely the drain of the TFT2, is connected to the negative power source VEE at the time point one horizontal line before the time point for turning the TFT1 on, and the charges accumulated in the capacitor of the organic EL element EL are discharged. As a result, when the gate line 1 for the TFT3 is then selected, block data is written, and an electrical current is prevented from flowing in the organic EL element EL when the TFT2 turns off, such that generation of an afterimage can be reliably prevented.

Figure 2:
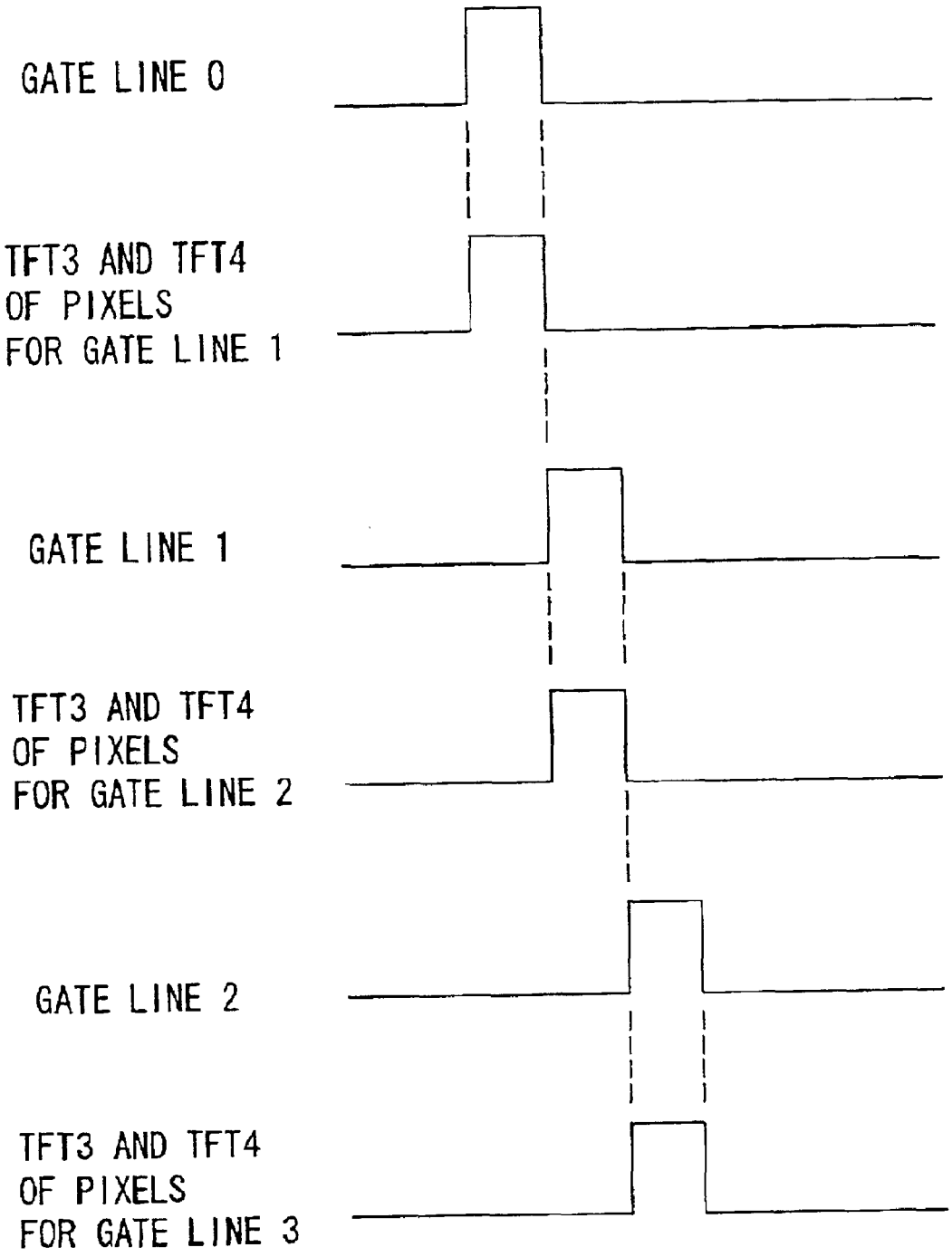
FIG. 2 is a timing chart showing the operation of the embodiment of FIG. 1.

For example, as shown in FIG. 2, when the gate line 0 is on, the TFT4 connected with the TFT1 which is to be turned on by the gate line 1 and the TFT3 connected with the EL are turned on, so that the charges accumulated in the capacitor of the organic EL element EL of each pixel for the gate line 1 are discharged. Further, when the gate line 1 is on, the TFT3 with regard to each of the pixels in the lines for the gate line 2 is turned on, so that the charges accumulated in the organic EL element EL for those pixels are discharged. The above-described operation will be performed in sequence for each gate line.

Figure 3:
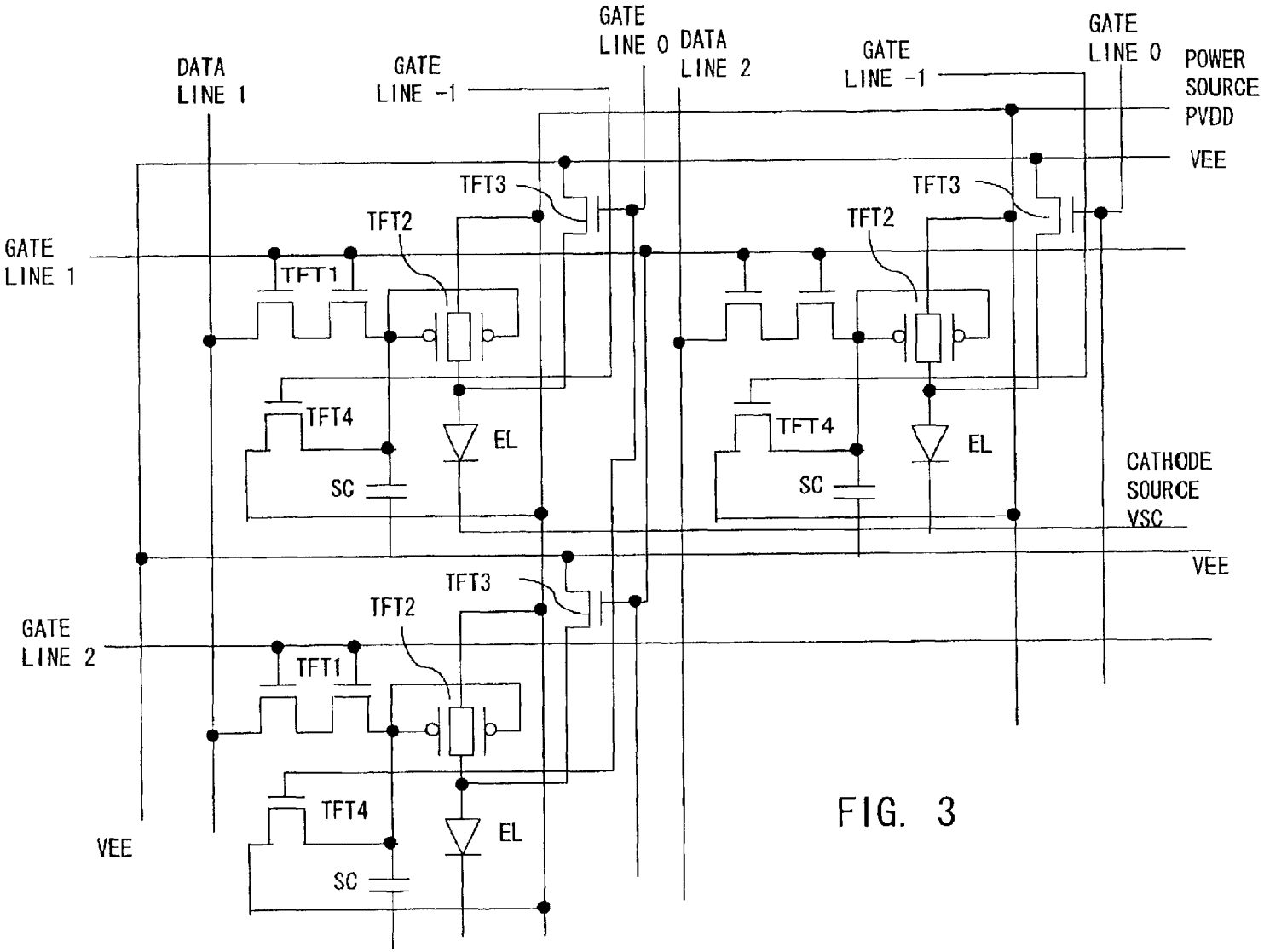
FIG. 3 is a diagram showing a structure of a pixel circuit according to another embodiment of the present invention.

FIG. 3 illustrates another embodiment, in which the other end of the TFT4 is connected to the gate line which is two lines above the gate line which is being selected, not to the upper gate line. In this structure, first, when the two-lines upper horizontal line is selected, the storage capacitor is charged by the PVDD, and the TFT2 is turned off. Then, when the upper horizontal line is selected, the TFT3 turns on to thereby discharge the capacitor of the organic EL. This structure further ensures the prevention of simultaneous on state of the TFT2 and the TFT3.

Figure 4:
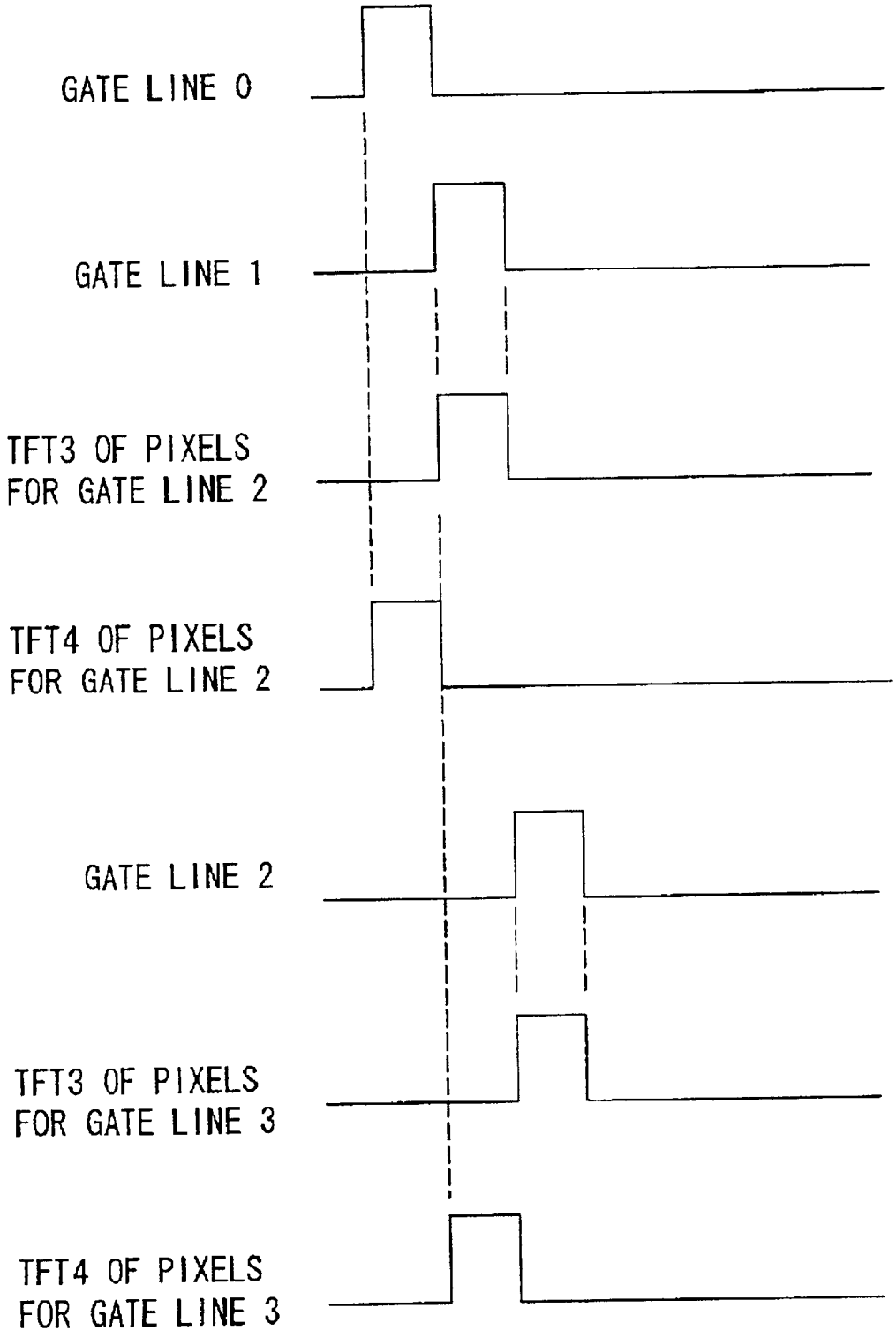
FIG. 4 is a timing chart showing the operation of the embodiment of FIG. 3.

For example, as shown in FIG. 4, when the gate line 0 is on, the TFT3 of the pixels for the gate line 1 and the TFT4 of the pixels for the gate line 2 are turned on. When the gate line 1 is on, the TFT3 of the pixels for the gate line 2 and the TFT4 of the pixels for the gate line 3 are turned on. In this manner, in each pixel, the TFT4 is first turned on so that the storage capacitor SC is charged to turn the TFT2 off, and subsequently the TFT3 is turned on to discharge the capacitor of the organic EL. Finally, the TFT1 is turned on so that the data writing is performed.

The timing at which the TFT3 and the TFT4 are turned on is not necessarily limited to when the upper gate line or the gate line two lines above the selected gate line is actuated, but may be at the actuation of gate lines higher up. Specifically, TFT3 and TFT4 may be turned on at any timing as long as they are actuated by a signal of a gate line which is selected prior to the gate line for those TFT3 and TFT4. Further, the TFT4 may be turned on at any timing as long as it is the same as or prior to the timing of actuating the TFT3. However, it is preferable that the timing of actuating the TFT4 be immediately before the timing of actuating the TFT3, because in this case the on period of the organic EL element can be extended and the wiring for the gate of TFT4 can be shortened.

As described, according to the above-described embodiment, the provision of the TFT3 can ensure the off state of the organic EL when the organic EL is switched off, thereby preventing the generation of an afterimage. Also, because the TFT4 is further provided, it is possible to prevent the TFT2 from turning on and also prevent the TFT4 from connecting the power source PVDD and the negative power source VEE, when the TFT3 is on.

It should be noted that the uppermost horizontal line does not have any upper lines. Therefore, the wiring may be drawn from the lowermost gate line or the gate line above the lowermost line. Alternatively, a dummy gate line (having no corresponding pixels) which is turned on during the vertical retrace interval may be provided to thereby turn the TFT3 and TFT4 on.

Figure 5:
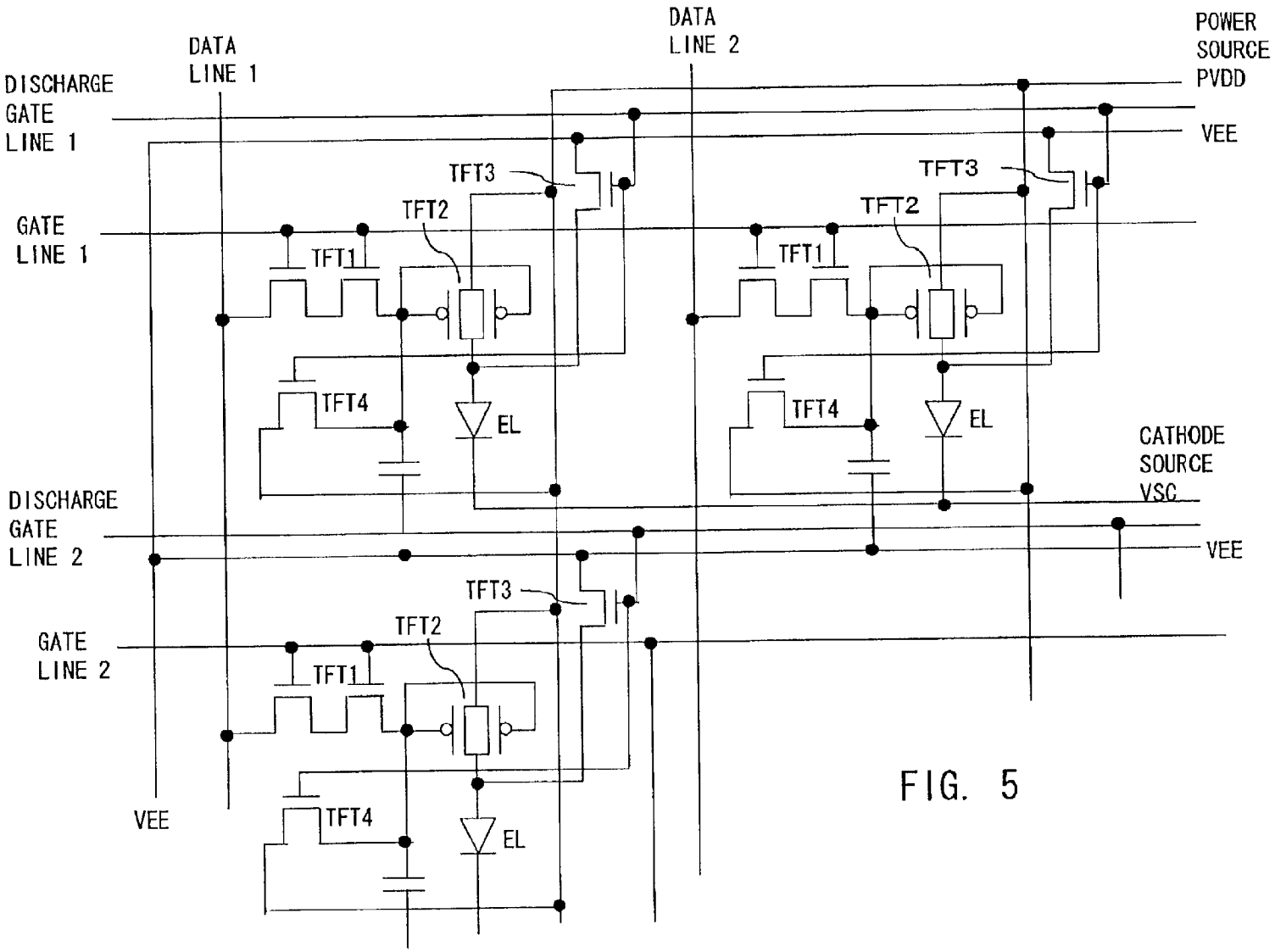
FIG. 5 is a diagram showing a structure of a pixel circuit according to still another embodiment of the present invention.

Referring to FIG. 5, still another embodiment is shown. In this embodiment, a discharge gate line dedicated to exclusive use for actuating the TFT3 and TFT4 (hereinafter referred to as a dedicated discharge gate line) is provided, and the gate of the TFT3 and TFT4 at each line is connected with the dedicated discharge gate line at that line.

Figure 6:
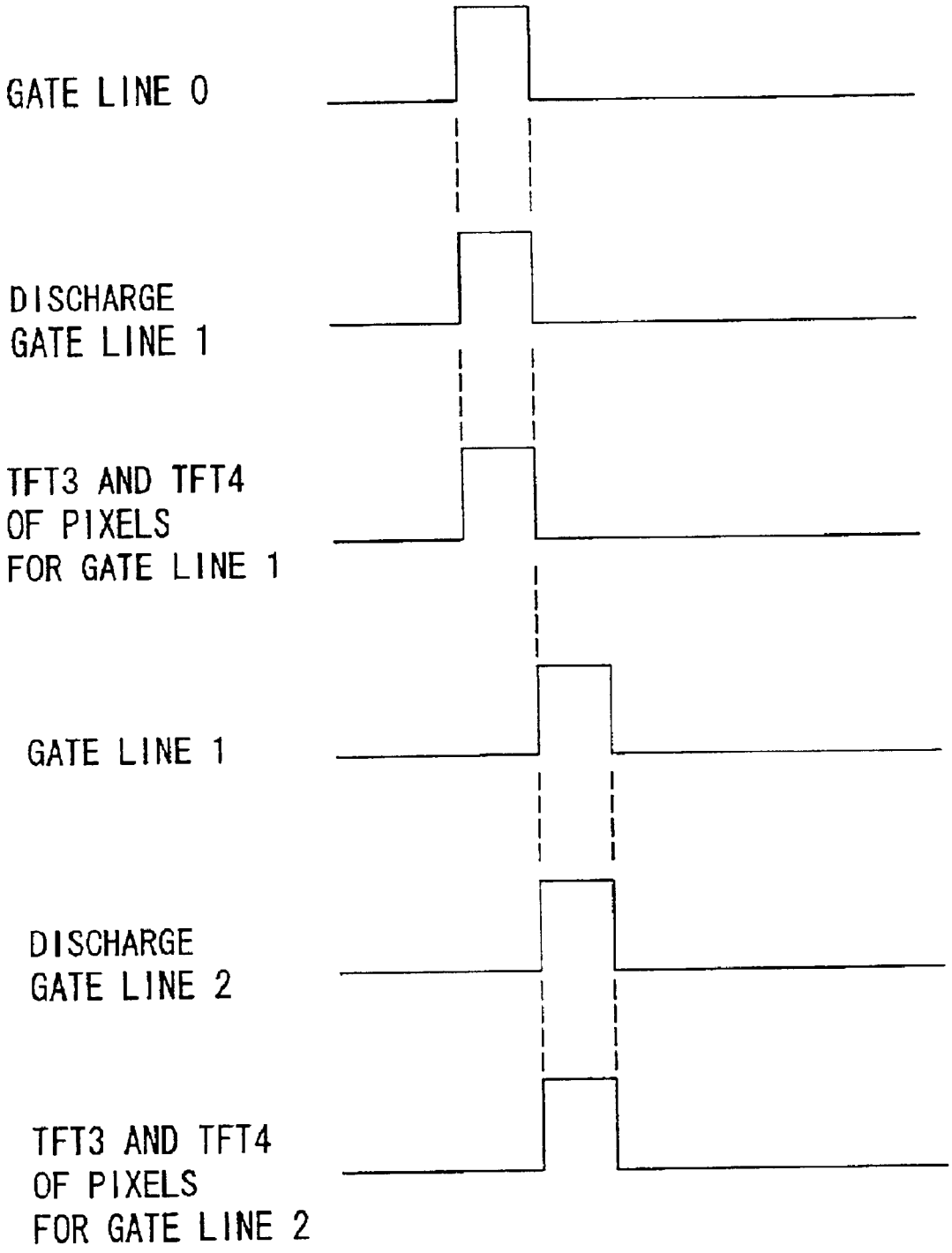
FIG. 6 is a timing chart showing the operation of the embodiment of FIG. 5.

As shown in FIG. 6, each dedicated discharge gate line is turned on (activated) simultaneously with the upper gate line. Therefore, as in the embodiment described in connection with FIG. 1, the TFT3 and TFT4 are turned on at the timing when the upper gate line is turned on. Alternatively, the TFT3 and the TFT4 may be connected with separate dedicated discharge gate lines, or one of the TFT3 and TFT4 may be connected to the gate line to thereby turn the TFT3 and TFT4 on at different timing.

Figure 7:
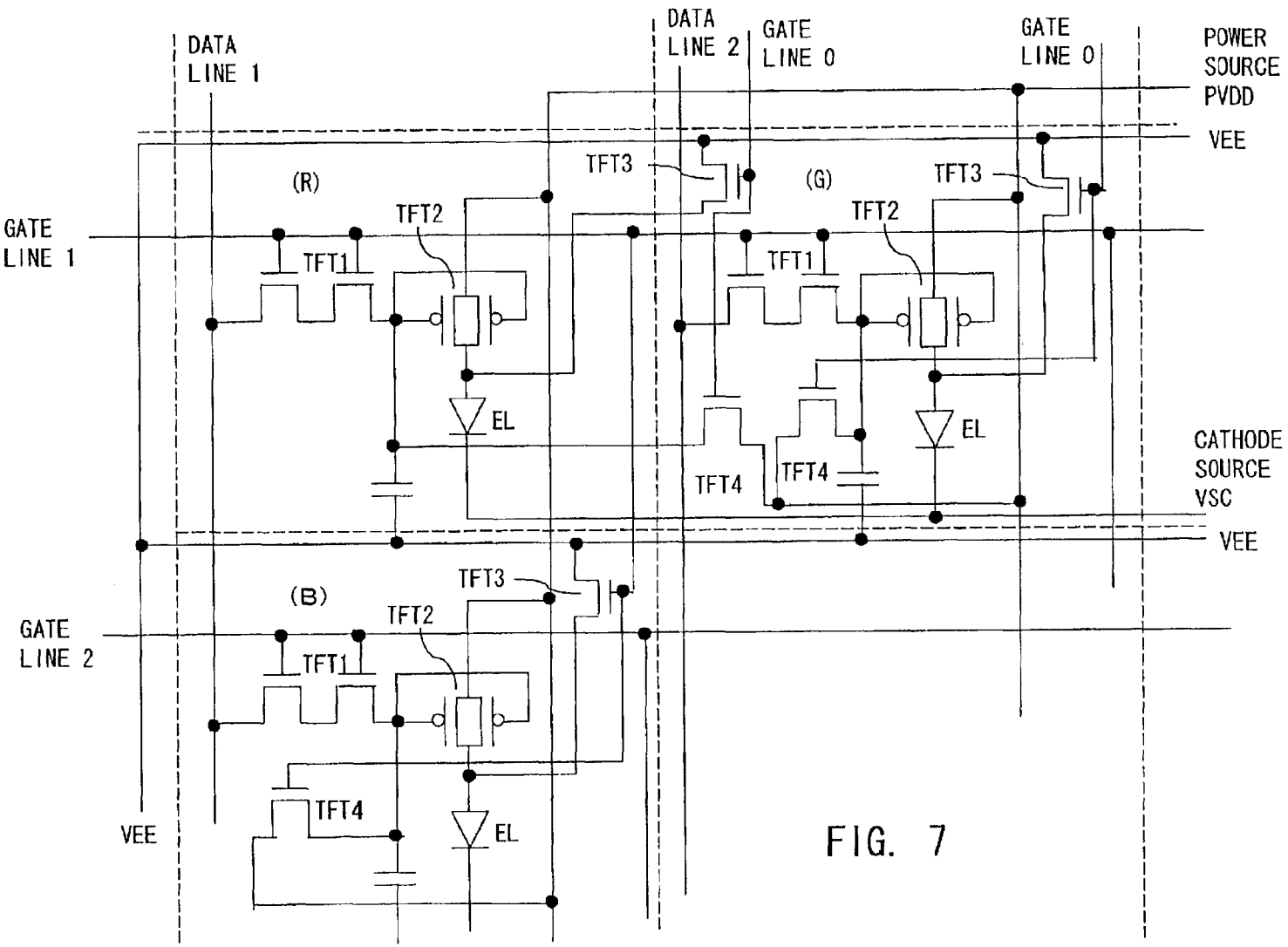
FIG. 7 is a diagram showing a structure of a pixel circuit according to a further embodiment of the present invention.
Figure 8:
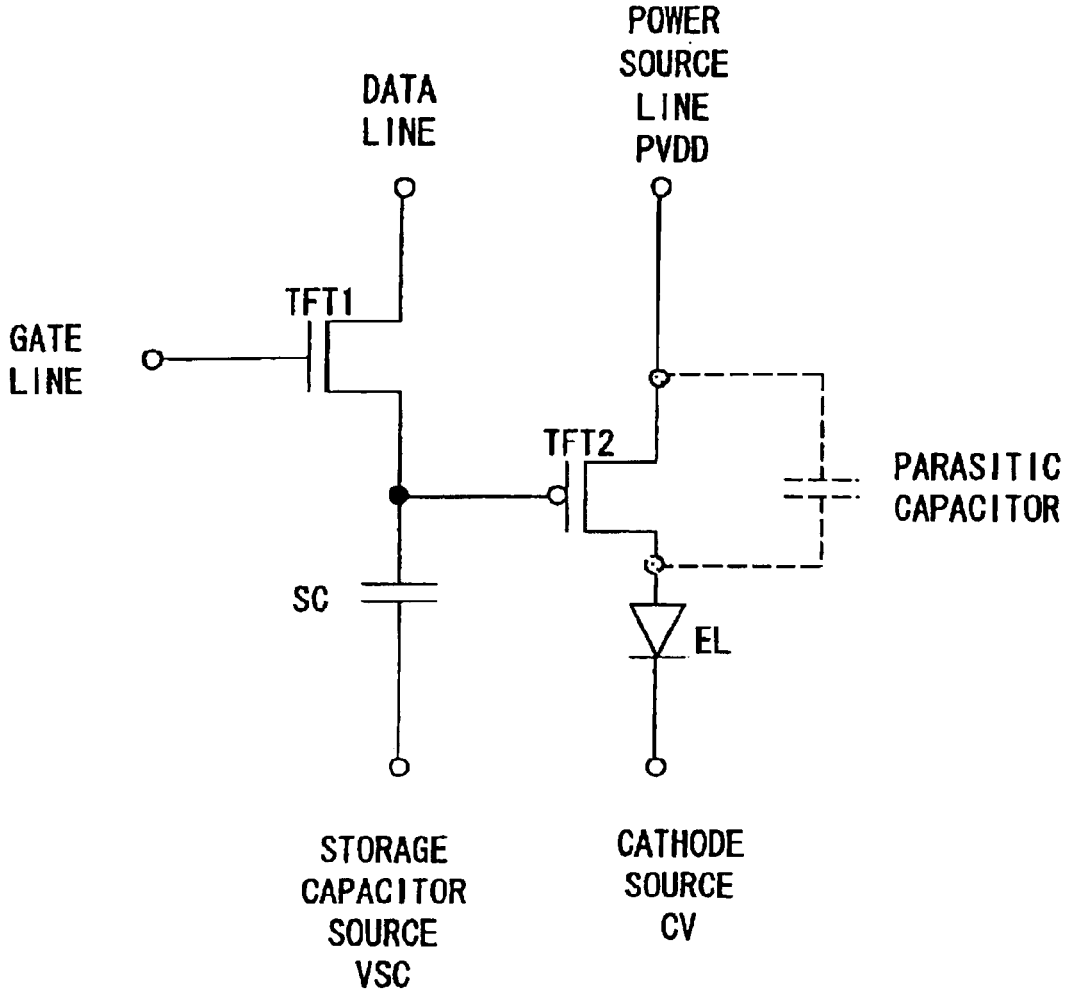
FIG. 8 PRIOR ART
FIG. 8 is a diagram showing an example structure of a conventional circuit.

FIG. 7 illustrates a further embodiment in which considerations are made with regard to the locations of the TFT3 and TFT4. In FIG. 7, three pixels are shown; the pixel at upper left corresponds to a R (red) pixel, the pixel at upper right corresponds to a G (green) pixel, and the pixel at lower left corresponds to a B (blue) pixel. It should be noted that the arrangement of the RGB pixels is not limited to this example, but may also be, for example, a stripe pattern in which pixels of the same color are arranged in the column direction, or any other suitable pattern.

According to this embodiment, the TFT3 and the TFT4 for the R pixel are located within the adjacent G pixel. Therefore, the number of the TFTs provided within the R pixel is smaller than that in the G pixel. Because the aperture ratio of a pixel decreases as the number of TFTs provided in the pixel increases, in this embodiment, the aperture ratio of the R pixel is larger than that of the G pixel.

In an organic EL element, typically, the emissive element for G has a high emission efficiency and is therefore relatively bright, while the emissive element for R has a low emission efficiency and is therefore relatively dark. By increasing the aperture ratio of the pixel for R emission while decreasing the aperture ratio of the pixel for G emission as in this embodiment, it is possible to compensate for the difference in the emission efficiency between these colors using the aperture ratio, thereby reducing the overall power consumption.

There is a possibility that some materials of the organic EL element result in the different order of levels of emission efficiency from those described above. Even in such a case, it is possible to provide the TFT of the pixel for the color with lower emission efficiency within the pixel for the color with higher emission efficiency. Further, although both the TFT3 and the TFT4 for one pixel (R pixel) are provided within another pixel (G pixel) in the embodiment of FIG. 7, it is also possible to provide either one of the TFT3 and TFT4 in another pixel.

It should be noted that FIG. 7 only illustrates an arrangement for a circuit diagram and that the position and size of the individual members or the like may be different from the actual layout. Further, in FIG. 7, the border line between the pixels is shown by dashed line.

It should be also noted that the polarity of each of the transistors is not limited to that described in the above examples, and may be the opposite. In such case, a signal would have the opposite polarity.

While the preferred embodiments of the present invention have been described using specific terms, such description is for illustrative purposes only, and it is to be understood that changes and variations may be made without departing from the spirit or scope of the appended claims.

What is claimed is:

1. An organic EL pixel circuit for controlling application of a drive voltage to a plurality of organic EL pixels, wherein a discharge transistor is provided for discharging charges accumulated in a capacitor of an organic EL element, and a driving transistor is provided between the organic EL element and a power source for controlling driving current to the organic EL element, and one end of the discharge transistor is connected between the driving transistor and the organic EL element; and the discharge transistor discharges charges that are accumulated on a node between the organic EL element and the driving transistor if the discharge transistor is turned on.

2. An organic EL pixel circuit for controlling application of a drive voltage to a plurality of organic EL pixels, wherein a discharge transistor is provided for discharging charges accumulated in a capacitor of an organic EL element, and a drive transistor is provided between the organic EL element and a power source for controlling driving current to the organic EL element, and one end of the discharge transistor is connected between the driving transistor and the organic EL element, wherein said organic EL pixels are arranged in a matrix and the pixels in a row direction are selected by a first gate line, and said discharge transistor is driven by a second gate line which is selected at a timing prior to the selection of the first gate line at the row of the EL element to which said discharge translator is connected, to discharge the charges accumulated in the capacitor of the organic EL element.

3. An organic EL pixel circuit for controlling application of a drive voltage to a plurality of organic EL pixels, wherein a discharge transistor is provided for discharging charges accumulated in a capacitor of an organic EL element, wherein said organic EL pixels are arranged in a matrix and the pixels in a row direction are selected by a same gate line, said discharge transistor is driven by a dedicated discharge line which is activated at a timing prior to the selection of the gate line at the row of the EL element to which said discharge transistor is connected, to discharge the charges accumulated in the capacitor of the organic EL element, and the discharge transistor discharges charges that are accumulated on a node between the organic EL element and a driving transistor if the discharge transistor is turned on.

4. An organic EL pixel circuit for controlling application of a drive voltage to a plurality of organic EL pixels, wherein a discharge transistor is provided for discharging charges accumulated in a capacitor of an organic EL element, and a driving current to the organic EL element, and a power source for controlling driving current to the organic EL element, and one end of the discharge transistor is connected between the driving transistor and the organic EL element, wherein said organic EL pixels are arranged in a matrix and each of the pixels emits light of a color which is predetermined for each pixel, and a discharge transistor for a pixel which emits light of a color with a low emission efficiency is provided within a pixel which emits light of a color with a higher emission efficiency.

5. An organic EL pixel circuit for controlling application of a drive voltage to a plurality of organic EL pixels, wherein a discharge transistor is provided for discharging charges accumulated in a capacitor of an organic EL element, wherein each of said pixels includes a storage capacitor for holding a control voltage to be applied to a drive transistor which controls application of a drive current to the organic EL element, and each of said pixels further includes a control transistor for controlling the control voltage held in storage capacitor to turn the drive transistor off, and the discharge transistor discharges charges that are accumulated on a node between the organic EL element and the driving transistor if the discharger transistor is turned on.

6. An organic EL pixel circuit for controlling application of a drive voltage to a plurality of organic EL pixels, wherein a discharge transistor is provided for discharging charges accumulated in a capacitor of an organic EL element, wherein each of said pixels includes a storage capacitor for holding a control voltage to be applied to a drive transistor which controls application of a drive current to the organic EL element, and each of said pixel further includes a control transistor for controlling the control voltage held in the storage capacitor to turn the drive transistor off, wherein said control transistor is driven simultaneously with said discharge transistor to turn the drive transistor off at the time of driving said discharge transistor.

7. An organic EL pixel circuit for control application of a drive voltage to a plurality of organic EL pixels, wherein a discharge transistor is provided for discharging charges accumulated in a capacitor of an organic EL element, wherein each of said pixels includes a storage capacitor for holding a control voltage to be applied to a drive transistor which controls application of a drive current to the organic EL element, and each of said pixels further includes a control transistor for controlling the control voltage held in the storage capacitor to turn the drive transistor off, wherein said control transistor is driven prior to said discharge transistor to turn the drive transistor off prior to driving of said discharge transistor.

8. An organic EL pixel circuit for controlling application of a drive voltage to a plurality of organic EL pixels, wherein a discharge transistor is provided for discharging charges accumulated in a capacitor of an organic EL element, wherein each of said pixels includes a storage capacitor for holding a control voltage to be applied to a drive transistor which controls application of a drive current to the organic EL element, and each of said pixels further includes a control transistor for controlling the control voltage held in the storage capacitor to turn the drive transistor off, wherein said organic EL pixels are arranged in a matrix and each of the pixels emits light of a color which is predetermined for each pixel, and a control transistor for a pixel which emits light of a color with a lower emission efficiency is provided within a pixel which emits light of a color with a higher emission efficiency.

9. An organic EL pixel circuit for controlling application of a drive voltage to a plurality of organic EL pixels, wherein a discharge transistor is provided for discharging charges accumulated in a capacitor of an organic EL element, and a driving transistor is provided between the organic EL element and a power source for controlling driving current to the organic EL element, and one end of the discharge transistor is connected between the driving transistor and the organic EL element, further comprising a plurality of discharge transistors in the organic EL pixels located at rows selected by a first gate line are driven by a second gate line which is selected before the selection of the first gate line.

10. An organic EL pixel comprising:

an EL element;

a driving transistor for controlling driving current to be supplied to the EL element;

a selecting transistor for controlling the driving transistor, a discharge transistor provided independently of the driving transistor and the selecting transistor for discharging charges accumulated in a parasitic capacitor of the EL element; and the discharge transistor discharges charges that are accumulated on a node between the EL element and the driving transistor if the discharge transistor is turned on.

11. An organic EL pixel circuit according to claim 10, wherein the discharge transistor is connected to a node connecting the driving transistor and the EL element.

12. An organic EL pixel circuit according to claim 11, wherein the discharge transistor is turned on when the selecting transistor is turned off.

* * * * *